United States Patent [19]

Shimizu

[11] 4,271,216

[45] Jun. 2, 1981

[54] METHOD FOR COATING A CYLINDRICAL CAN BODY

[75] Inventor: Hiromichi Shimizu, Sagamihara, Japan

[73] Assignee: Daiwa Can Company, Limited, Tokyo, Japan

[21] Appl. No.: 131,683

[22] Filed: Mar. 18, 1980

[30] Foreign Application Priority Data

Apr. 5, 1979 [JP] Japan ..... 54/41421

[51] Int. Cl.[3] ..... B05D 1/28

[52] U.S. Cl. ..... 427/428; 427/409; 118/218; 118/219; 118/224; 118/230; 118/232

[58] Field of Search ..... 427/428, 409; 118/209, 118/218, 219, 221, 223, 224, 230, 232

[56] References Cited

U.S. PATENT DOCUMENTS

| | | | |
|---|---|---|---|
| 947,537 | 1/1910 | Woods | 118/230 X |
| 2,329,263 | 9/1943 | Gladfelter et al. | 118/230 X |
| 2,704,530 | 3/1955 | Nilsen et al. | 118/224 |
| 3,563,170 | 2/1971 | Cuacho et al. | 118/230 X |
| 3,855,967 | 12/1974 | Skrypek et al. | 118/232 X |
| 3,991,236 | 11/1976 | Fleissner | 118/325 X |
| 4,089,294 | 5/1978 | Lasiewicz et al. | 118/232 X |
| 4,092,949 | 6/1978 | Balordi | 118/232 X |
| 4,138,965 | 2/1979 | Riese et al. | 118/232 X |

*Primary Examiner*—Shrive P. Beck

*Attorney, Agent, or Firm*—Waston, Leavenworth, Kelton & Taggart

[57] ABSTRACT

A cylindrical can being transported along a vertical circular passageway is passed through a first application zone where a part of the given amount of white paint is applied to all the outer surface of the can body and then advanced to a second application zone where the rest of said white paint is applied to all the said coated surface.

2 Claims, 3 Drawing Figures

METHOD FOR COATING A CYLINDRICAL CAN BODY

BACKGROUND OF THE INVENTION

1. Field of the Invention

This invention relates to an improved method of applying white paint by rolls to the outer surface of a cylindrical can body.

2. Description of the Prior Art

Some cylindrical can bodies are formed of soft metals such as aluminum or plated or unplated metals such as steel by various working methods such as deep drawing, multiple drawing and drawing/ironing. The cans are generally coated with protective paints on their outer surface alone or both inner and outer surfaces after they have been formed cylindrically. White paint containing titanium white is commonly used for application to the outer surface of a can body since it also serves as a primer for subsequent printing.

One conventional method of applying white paint to the outer surface of a can body is described by reference to FIG. 1, wherein A is a can body, 1 is a guide trough for feeding can bodies, 2 is a vertical circular passageway along which the can bodies are transported, 3 is an application zone provided midway said passageway, and 4 is a rotary application roll so positioned as to make contact with the outer surface of the can body at said midway application zone. Represented by 5 and 6 are a pair of fountain rolls which contact each other, the roll 5 also contacting the application roll 4 at a contact place 11. Hereunder, the rolls 4, 5 and 6 are referred to generically as an application unit. A scraper roll 7 is beneath and contacts the application roll 4 to wipe the remaining paint from said roll 4.

In operation, the cylindrical can body A is guided by the trough 1 to enter the circular passageway 2 along which it is transported, as supported by a mandrel extending in a direction perpendicular to said passageway, and it reaches the application zone 3. As the can body is passed through the zone 3, all of its outer surface is contacted by the application roll 4. The white paint 9 stored between the fountain rolls 5 and 6 is carried on the outer surface 10 of the rotating roll 5 up to a contact place 11 of the rolls 4 and 5 where part of it is transferred onto the outer surface 8 of the application roll 4 as shown in FIG. 2. A part of the transferred paint is further transferred onto the outer surface of the can body in the application zone 3 as shown in FIG. 2. Usually, a given amount of paint is transferred from the application roll 4 to the can body A while the can makes a little-over the predetermined number of revolutions in rolling-contact relationship with the roll 4.

As a result of that, the greater part of the outer surface of the can body is subjected to the predetermined number of applications of paint whereas the remaining little part is subjected to applications of paint in the number which is more than the predetermined number by one. Hereinafter the remaining little part coated in such a manner is referred to as a multi-coated part. This multi-coated part looks whiter than said greter-part, causing a distinct difference in degree of color lightness.

If more cans are fed per unit time, each can passes the application zone 3 in a shorter period of time during which it makes a predetermined number of revolutions to be applied a given amount of paint, and this requires a corresponding increase in the peripheral speed of the can body. Since the application roll 4 makes rolling contact with the can body, the increase in the peripheral speed of the can must be accompanied by an increase in the rotational speed of the roll 4. And then, an increased amount of paint will be thrown off from the rolls at the place 11 where the transfer of paint occurs as shown in FIG. 2, to form a deposit on the applicator assembly to spoil its normal operation and/or on the supporting mandrel to stain the inner surface of the can that the mandrel supports.

SUMMARY OF THE INVENTION

Therefore, one object of this invention is to provide a method of applying white paint by rolls to all the outer surface of a cylindrical can body without throwing off paint that might dirty a part of the can and the applicator assembly.

Another object of this invention is to provide a method for applying white paint by rolls to all the outer surface of a cylindrical can body without causing substantially difference in degree of color lightness between a multi-coated part and a non multi-coated part and without throwing off paint that might dirty a part of the can and the applicator assembly.

A further object of this invention is to provide an application method that achieves a coating having a higher degree of color lightness with a given amount of white paint than the degree of color lightness brought by the conventional method that accomplishes the coating operation in only one application zone.

Yet another object of this invention is to provide an application method that requires less paint to achieve the same degree of color lightness.

According to this invention, a method of applying a given amount of white paint by rolls to all the outer surface of a cylindrical can body being transported along a vertical circular passageway as it is supported by a supporting element extending in a direction perpendicular to said passageway, wherein all the said outer surface of a cylindrical can body is brought into contact with a first rotating application roll being close to said passageway, and carrying white paint, thereby transferring the white paint in a partial amount of said given amount from said first application roll onto said outer surface of the can body to coat said surface, said coated outer surface of the can body then being brought into contact with a second rotating application roll carrying white paint, being close to said passageway and positioned ahead of the first application roll in the advancing direction of the can, thereby transferring the white paint in the rest of said given amount from said second application roll onto the coated outer surface of the can body to coat said surface.

DESCRIPTION OF PREFERRED EMBODIMENTS

Figure 3:
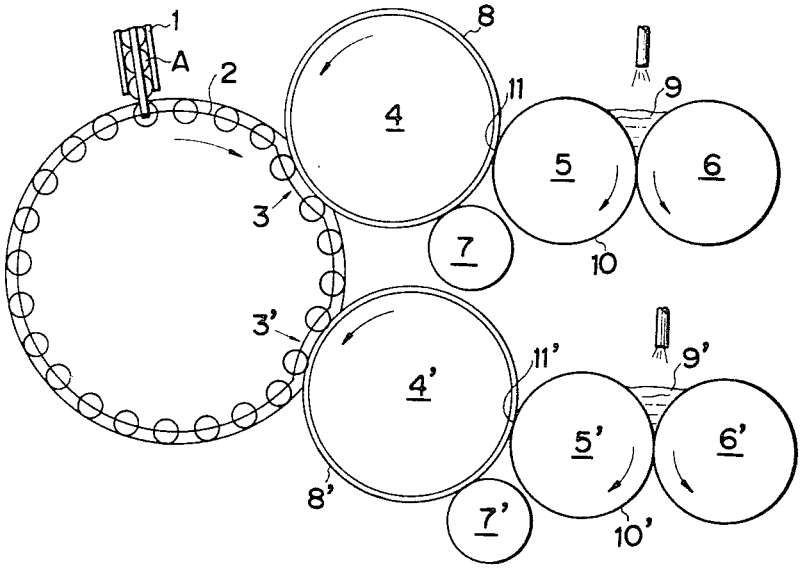
FIG. 3 shows essential parts of the assembly in the application method of this invention.

Preferred embodiments of this invention are hereunder described by reference to the accompanying drawings. As will be understood from FIG. 3, the apparatus used in the method of this invention differs from the conventional apparatus shown in FIG. 1 in that it has two application units whereas the latter has only one such unit. In FIG. 3, symbol A and numerals 1 to 11 show the same elements as ones in FIG. 1, and numerals 3' and 11' show the newly added application unit and its associated elements and they correspond to the numerals 3 thru 11, respectively; therefore, 4', 5', 6' and 7' are respectively an additional application roll, a pair of fountain rolls, and a scraper roll; 3' is an additional application zone between the application roll 4' and the can body A; 11' is a place of contact between the roll 4' and the fountain roll 5'; 9' is paint; 8' is the outer surface of the roll 4'; and 10' is the outer surface of the roll 5'.

One embodiment of this invention using an apparatus of the construction described above is now described in comparison with examples of the conventional technique.

A 202-dia. metal can (about 130 mm high) having an open top and an integrally formed bottom was coated with white paint (a blend of acrylic resin paint and titanium white in a weight ratio of 10:15) in a dry coating weight (weight of paint after dried) of about 110 mg/dm$^2$ by means of the application roll 4 of the first application unit, and further coated with the same paint with the application roll 4' of the second application unit to provide a total dry coating weight of about 200 mg/dm$^2$. The coated cans were transported at a rate of 700 cans per minute, and each has a multicoated part wherein the paint was applied three times, in an average width of about 2.5 mm which showed a slight difference in degree of color lightness from the remaining greater part wherein the paint was applied twice. In this case, however, no paint was thrown off, and both the can and the applicator assembly were not dirtied at all.

Figure 1:
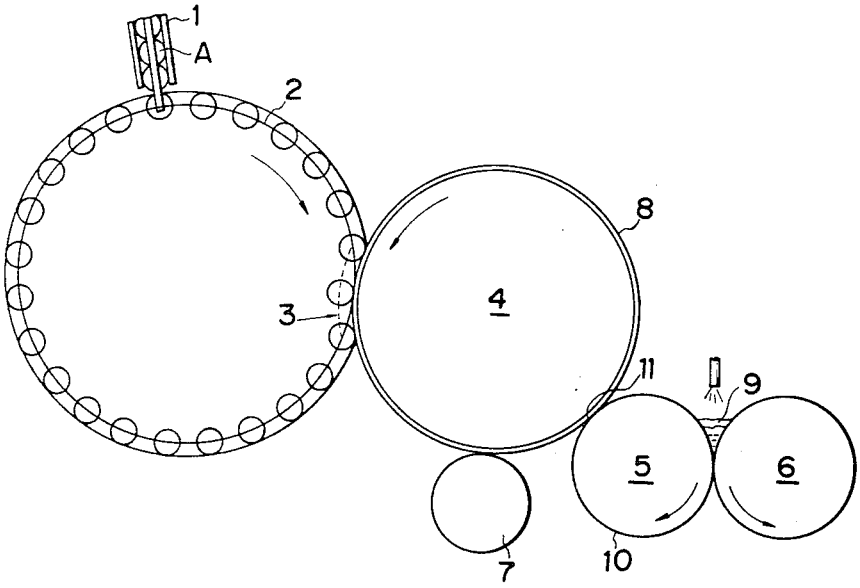
FIG. 1 shows essential parts of the assembly used in the conventional application method.
Figure 2:
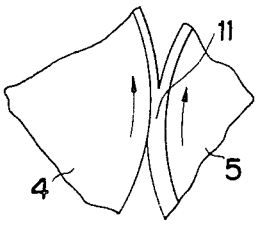
FIG. 2 illustrates how paint is transferred from a fountain roll 5 to an application roll 4.

As a first example of the conventional technique, the apparatus shown in FIG. 1 was used to coat cans of the same dimension as described above with white paint the same as employed above to give a dry coating weight of about 200 mg/dm$^2$ at a rate of 700 cans per minute. In this instance, each can was coated by a single application of the paint in the application zone 3. Some paint was thrown off at the contact plate 11 between the application roll 4 and the fountain roll 5, and a slight amount of the paint was also thrown off from the application zone 3. In a rare case, even the formation of a paint deposit was observed on the mandrel which was yet to receive a can. These defects are presumably due to the great difference in paint thickness between the outer surfaces of the rolls 4 and 5 as compared with the method of this invention. In these control cans, the multi-coated part, that is, a part wherein the paint was applied twice, was noticeably higher in the difference in degree of color lightness than the remaining single-coated part when observed with the naked eye. Such difference was more conspicuous than that in the can coated by the method of this invention.

As a second example of the prior art technique, the apparatus shown in FIG. 1 was used to coat cans of the same dimension as described above with white paint of the same composition as employed about to give a dry coating weight of about 200 mg/dm$^2$ at a rate of 700 cans per minute. In this instance, each can made a little over two revolutions in the application zone 3. The number of rotation of the application roll 4 was twice that of the same roll used in the first instance, and due to this high rotational speed, nevertheless amount of the paint on the roll 4 was less than that in the first example, much paint was thrown off from the roll 4. Moreover, the difference in degree of color lightness in the can was greater than that in the can processed by the method of this invention.

In another embodiment of this invention, the first application roll carrying white paint was brought into rolling-contact relationship with a can for a period time when the can was making a little over two revolutions, and thereafter, white paint the same as what was transferred onto the can from the first application roll was applied to said coated can in a total dry coating weight of about 350 mg/dm$^2$ by means of the second application roll that was also brought into rolling-contact relationship with the can during the time when the can was making a little over two revolutions. The same procedure was repeated to coat twenty cans with white paint, and they were checked for the degree of color lightness at four selected points in the circumferential direction of each can. The average value of the degree of color lightness was about 88 according to the scale whereon pure black was represented by zero and pure white by 100.

As another example of the conventional technique, twenty cans were coated with white paint which was the same as used in the above embodiment of this invention by means of a single application roll which was brought into contact with each can during the time when it was making a little over four revolutions, thereby providing a total dry coating weight of about 350 mg/dm$^2$. The cans were then checked for the degree of color lightness in the same manner as described above. The average value of said degree was about 87. This value 87 could be obtained by the method of this invention with white paint applied in a total dry coating weight of about 290 mg/dm$^2$. Therefore, in comparison with the conventional application method which achieves the coating with a single application roll, the method of this invention can provide a higher degree of color lightness with a given amount of paint. In other words, this invention can provide a desired degree of color lightness using less white paint than has been required in the conventional technique. Hence, one great advantage is the saving of paint.

As described in the foregoing, in this invention, a given amount of white paint is applied onto the can in two application zones, one in a first application zone, and the remainder in a second application zone. As a result, compared with the conventional method in which a given amount of paint is applied in only one application zone, less paint is thrown off, the degree of color lightness in the multi-coated part and that in the remaining part is substantially equal to each other, and less paint suffices for achieving the same degree of color lightness. These advantages combine together to provide one great merit of paint saving.

In the embodiments illustrated above, only one coating operation is effected in each application zone, and whether two or three coating operations are effected in each zone, the resulting advantage is greater than when all of a given amount of paint is used in a single application zone.

It is to be understood that the method of this invention is also applicable to a coating operation wherein the white paint to be used in a first application zone contains a different amount of titanium white than that to be used in a second application zone.

It will be apparent that various changes in form and details can be made in the method of the invention without departing from the spirit and scope thereof, the forms hereinbefore described being merely preferred embodiments thereof.

What is claimed is:

1. A method of applying a given amount of white paint by rolls to all the outer surface of a cylindrical can body which is transported along a passageway as it is supported by a supporting element extending in a direction perpendicular to said passageway, wherein all the said outer surface of the cylindrical can body is brought into contact with a first rotating application roll being close to said passageway and carrying white paint, thereby transferring the white paint in a part of said given amount from said first application roll onto said outer surface of the can body to coat said surface, said coated outer surface of the can body then being brought into contact with a second rotating application roll carrying white paint, being close to said passageway and positioned downstream of the first application roll in the advancing direction of the can, thereby transferring the white paint in the rest of said given amount from said second application roll onto the coated outer surface of the can to coat said surface.

2. A method as claimed in claim 1 in which said passageway is vertical and circular.

* * * * *